US005279449A

United States Patent [19]

Sestak

[11] Patent Number: 5,279,449

[45] Date of Patent: Jan. 18, 1994

[54] DISPENSER HAVING SHREADED BORES FOR DISPENSING PARTICULATE MATERIAL

[76] Inventor: Richard J. Sestak, 17 Lowry Ct., Sterling, Va. 20165

[21] Appl. No.: 990,179

[22] Filed: Dec. 14, 1992

[51] Int. Cl.[5] ..... A47G 19/00

[52] U.S. Cl. ..... 222/142.1; 222/552

[58] Field of Search ..... 222/142.1-142.5, 480, 481, 482, 549, 552, 554, 563; 215/356

[56] References Cited

U.S. PATENT DOCUMENTS

| | | | |
|---|---|---|---|
| 462,456 | 11/1891 | Smith | 222/481 X |
| 922,453 | 5/1909 | Burgner | 222/552 X |
| 2,172,644 | 9/1939 | Smith | 222/552 |
| 2,348,014 | 5/1944 | Mallard | 222/481 |
| 3,122,275 | 2/1964 | Maxim | 222/142.4 |

FOREIGN PATENT DOCUMENTS

| | | | |
|---|---|---|---|
| 128629 | 6/1948 | Australia | 222/554 |
| 641111 | 5/1962 | Canada | 222/552 |

*Primary Examiner*—Andres Kashnikow
*Assistant Examiner*—Anthoula Pomrening

[57] ABSTRACT

A dispenser for the dispensing of particulate solids such as salt and pepper. The dispenser comprises a dispenser body having a plurality of open-ended cylindrical bores, each bore defining a space adjacent the bottom end thereof into which particulate material can be inserted and the open ends of the bores being threaded to receive a threaded closure. A threaded closure is associated with each of the bores. The threaded open ends of the bores include openings which allow the spaces to communicate with the exterior of the body only when the threaded closures are partially unthreaded.

4 Claims, 1 Drawing Sheet

DISPENSER HAVING SHREADED BORES FOR DISPENSING PARTICULATE MATERIAL

TECHNICAL FIELD

This invention relates to dispensers adapted for the dispensing of particulate solids, such as salt and pepper, and which are particularly adapted to be carried into the field, as for use on camping trips.

BACKGROUND ART

The dispensing of condiments, such as salt and pepper, has long been commonplace. However, most such dispensers will dispense only a single material, that material has minimal protection from the environment, and the material will spill out if the dispenser is tossed about. As a result the ordinary dispenser is poorly adapted to be taken on camping trips where humid atmospheres are frequently encountered and where the dispenser is often inverted and shaken unintentionally.

Moreover, only a single material is dispensed when the dispenser is used, so a plurality of dispensers must be carried when plural materials are to be dispensed, and the fewer items taken on a camping trip the better. Also, the outlet openings are a fixed aspect of a dispenser, and these are either all open or all closed at any given moment and there is no way to adjust the number of these openings in use at any time. There is thus little opportunity to adjust the amount of material which is dispensed with a single shake of the dispenser.

Other aspects of this invention will become apparent from the description which follows.

SUMMARY OF THE INVENTION

In accordance with this invention, a dispenser body is formed to define at least one, and preferably a plurality, of cylindrical bores which extend into the body, preferably from one side thereof, and which terminate within the body. The open ends of these bores are threaded to receive a threaded closure which extends part-way into the bores to define a space adjacent the bottoms thereof which can be filled to contain a plurality of different material, such as salt and pepper when there are two bores.

The threaded portions of these bores are further formed with openings which extend from the inside of the bores to the exterior of the body so that particulate material disposed within the bores can be dispensed therefrom when a threaded closure is partially unthreaded to allow the space adjacent the bottom of a bore to communicate with the exterior of the dispenser body.

A plurality of openings positioned at different elevations above the bottoms of the bores is preferably used so that the number of openings which can be used for dispensing will vary with the extent to which the threaded closure is unscrewed.

DETAILED DESCRIPTION OF THE INVENTION

Figure 1:
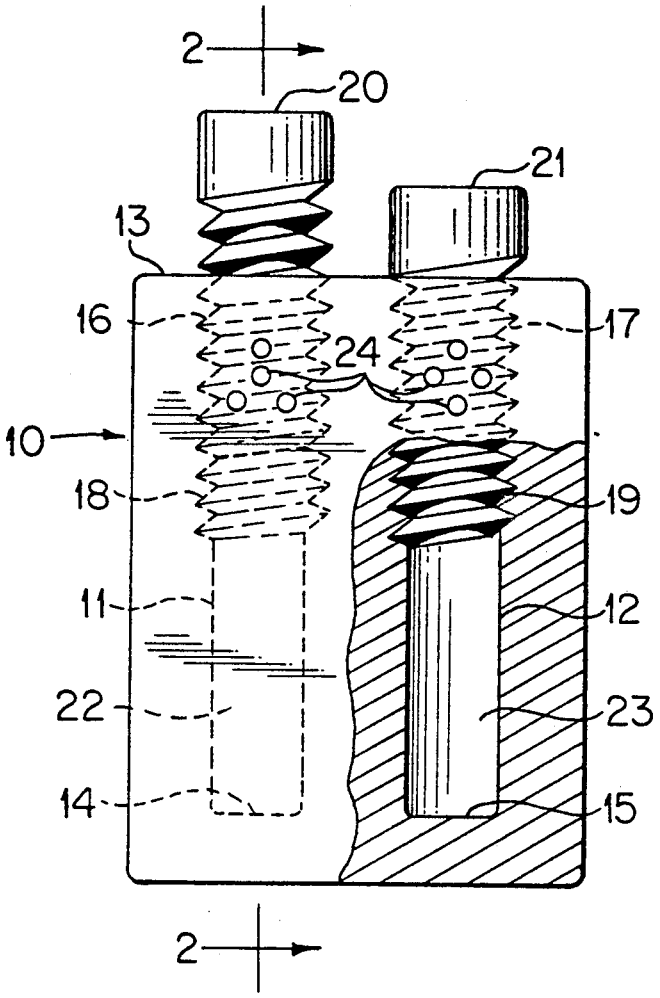
Figure 2:
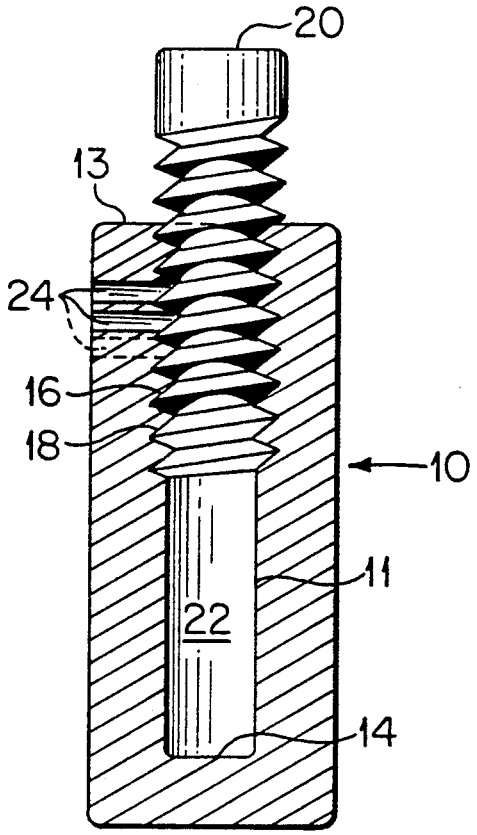

This invention will be described by reference to an illustrative dispenser adapted to be carried on camping trips and which can dispense salt and pepper, as needed, when the appropriate threaded closure is unscrewed to the desired extent. This illustrative dispenser is shown in the accompanying drawings in which:

FIG. 1 is a side view of a dispenser having two dispensing bores, parts being broken away to show portions of the interior of the device; and FIG. 2 is a cross-sectional view of the structure shown in FIG. 1, the cross-section being taken on the line 2—2 of FIG. 1.

Referring more particularly to the drawings, the illustrative dispenser shown in FIG. 1 is made of wood which has been drilled to form two cylindrical bores 11 and 12 in a wooden block 10. These bores are positioned side-by-side and extend into the block 10 through face 13 thereof and terminate in bottoms 14 and 15 within the block.

The side-by side positioning shown is preferred, but it can be varied, as by having one bore extending into one side of the block 10 and the other bore extending into the other side of the block. Similarly, the face 13 is shown flat, but it could be curved and the bores 11 and 12 could then be parallel or at a slight angle to one another. The important point is that there is more than one bore so that a plurality of particulate materials can be stored in a single unit and either or both dispensed as needed.

The upper ends 16 and 17 of the bores 11 and 12 are threaded, as indicated at 18 and 19, and these threads preferably terminate short of the bottoms 14 and 15 so that the threaded closures 20 and 21 can be screwed home to tightly close the bores 11 and 12 while leaving spaces 22 and 23 for storage of material to be dispensed, such as salt in space 22 and pepper in space 23.

As can be seen in the broken away portion of FIG. 1, the unthreaded lower portions of bores 11 and 12 are narrower than the threaded portions 16 and 17. When the device is formed by drilling a wooden block the bores 11 and 12 are drilled and the upper portions of these bores are threaded so that the threaded portion is wider than the bottom of the bores. So when the threaded closures 20 and 21 are screwed home, the holes 24 which extend through the block 10 in the threaded portion of bores 11 and 12 are blocked by the threaded portions of closures 20 and 21 which prevents the particulate solids from getting out and the air from getting in when the bottom of the threaded closures seat against the upper ends of spaces 22 and 23. This prevents inadvertant dispensing when the dispenser is carried and thrown about, as in a knapsack, and it protects the contents of spaces 22 and 23 from the atmosphere in a space of minimal size.

When the threaded closure is partially unscrewed, as in FIG. 1, then one or more of the openings 24 is placed into communication with one of the spaces 22 and 23, and this allows the contents of that space to be shaken out of the dispenser. The more the threaded closure is unscrewed, the more openings are made available and the faster the contents of the space can be shaken out. This provides a control of the dispensing operation which is not usually available.

It will be evident that the dispenser can be varied considerably depending upon the material selected and the dispensing purpose. Thus, while wood is a preferred material, the dispenser can also be molded out of any appropriate plastic, such as polymethyl methacrylate. Similarly, while plural dispensing compartments are preferred, one can obtain some of the advantages of this invention with a dispenser having only a single compartment. Many other variations will be evident to those skilled in the art.

What is claimed is:

1. A dispenser comprising a dispenser body formed to define a plurality of open-ended cylindrical bores which extend into the body and which terminate within the body, each bore defining a space adjacent a bottom end thereof into which particulate material can be inserted, the open ends of each of said bores being threaded to receive a threaded closure, and a threaded closure associated with each bore, said threaded closures extending part-way into each of said bores to further define the spaces which can be filled to contain a plurality of different particulate materials, the threaded open ends of said bores being formed with openings which extend from the inside of said bores to the exterior of said body so that particulate material within the bores can be dispensed therefrom when said threaded closures are partially unthreaded to allow the spaces adjacent the bottom ends of the bores to communicate with the exterior of the dispenser body.

2. A dispenser as recited in claim 1 in which said openings are positioned at different elevations above the bottom ends of said bores so that the number of openings which can be used for dispensing will vary with the extent to which said threaded closures are unscrewed.

3. A dispenser as recited in claim 1 in which said bores extend into said body from one side thereof.

4. A dispenser as recited in claim 1 in which the diameter of the bores adjacent their bottom ends is smaller than the diameter of the bores adjacent the threaded open ends so that said threaded closures will seal against the upper end of said spaces adjacent the bottom ends of said bores when said threaded closures are screwed to abut the upper end of said spaces.

* * * * *

UNITED STATES PATENT AND TRADEMARK OFFICE

CERTIFICATE OF CORRECTION

PATENT NO. : 5,279,449

DATED : January 18, 1994

INVENTOR(S) : Richard J. Sestak

It is certified that error appears in the above-indentified patent and that said Letters Patent is hereby corrected as shown below:

There is an obvious typographical error on line [54] and line 1 of column 1, the title description.
In both cases, the word "SHREADED" should be: "THREADED".

The following corrections are made:

[54] DISPENSER HAVING SHREADED BORES
FOR DISPENSING PARTICULATE
MATERIAL

Should be:

[54] DISPENSER HAVING THREADED BORES
FOR DISPENSING PARTICULATE
MATERIAL and,

1

DISPENSER HAVING SHREADED BORES FOR
DISPENSING PARTICULATE MATERIAL

UNITED STATES PATENT AND TRADEMARK OFFICE

CERTIFICATE OF CORRECTION

PATENT NO. : 5,279,449

DATED : January 18, 1993

INVENTOR(S) : Richard J. Sestak

It is certified that error appears in the above-indentified patent and that said Letters Patent is hereby corrected as shown below:

Should be:

1

DISPENSER HAVING THREADED BORES FOR
DISPENSING PARTICULATE MATERIAL

Signed and Sealed this

Twenty-sixth Day of April, 1994

*Attest:*

Bruce Lehman

BRUCE LEHMAN

*Attesting Officer*

*Commissioner of Patents and Trademarks*